United States Patent [19]

Kay

[11] 4,158,320

[45] Jun. 19, 1979

[54] MITER DEVICE

[75] Inventor: Spencer Kay, Edmonton, Canada

[73] Assignee: Nation Wide Manufacturing Co., Edmonton, Canada

[21] Appl. No.: 862,537

[22] Filed: Dec. 20, 1977

[51] Int. Cl.[2] ..... B27G 5/02

[52] U.S. Cl. ..... 83/425; 83/437; 83/477.2; 83/522; 83/581

[58] Field of Search ..... 83/477.2, 425, 435, 83/435.1, 581, 437, 522

[56] References Cited

U.S. PATENT DOCUMENTS

| | | | |
|---|---|---|---|
| 808,889 | 1/1906 | Von Culin | 83/477.2 X |
| 2,930,418 | 3/1960 | Moore | 83/477.2 X |
| 2,990,862 | 7/1961 | Ruben | 83/425 X |
| 3,138,180 | 6/1964 | Schultz | 83/437 X |
| 3,285,303 | 11/1966 | Kwiatkowski | 83/477.2 X |

*Primary Examiner*—Frank T. Yost
*Attorney, Agent, or Firm*—Ernest Peter Johnson

[57] ABSTRACT

A jig, having two fixed jig faces forming a right angle, is rotatably mounted on a guide rail which can slide in each of the linear grooves formed parallel to and on opposite sides of a conventional wood-cutting saw table. Complementary cuts for the construction of mitered corners are obtained by directing the apex of the jig parallel to the cutting blade. The first cut is made by supporting the wood on the appropriate jig face as it is guided through the blade. Without changing its setting relative to the guide rail, the jig is transferred to the groove on the opposite side of the blade and a second cut is made.

4 Claims, 8 Drawing Figures

MITER DEVICE

BACKGROUND OF THE INVENTION

This invention relates to improvements in a miter device and particularly to that class of miter devices designed to be used in conjunction with a wood-cutting table saw.

A problem frequently encountered in the construction of right-angled mitered corners is the difficulty of obtaining an exact 45° cut on each of the two elements forming the corner. If a miter device of semi-circular design is used, the setting is adjusted to 45° and the first slab to be cut is pushed through the saw while it is supported against the miter. To obtain the corresponding cut of the second slab, the setting on the miter device is readjusted by rotating it through 90° to obtain the complementary 45° cut. Again the slab is supported against the miter device and pushed through the saw. Any error in either of the settings will result in non-parallel cuts in the two slabs which, when brought together, will not form a 90° angle.

A right-angled triangular jig mounted on the slidable surface of a cutting table has been described by Repp in U.S. Pat. No. 1,179,140. The apex of the jig is directed parallel to the axis of rotation of the saw when the jig is set for 45° cuts. The first piece of material to be cut is mounted against the jig and pushed through the saw to obtain a 45° angle. To obtain the complementary cut, the second piece of the material would have to be fed in on the opposite side of the jig either by following the jig into the cutting blade or by approaching the cutting blade from the opposite direction. Both these operations are considered bad practice in the field; in the former instance, the material is not securely supported by the jig while, in the latter, the cutting blade is rotating in the wrong direction and bites into the material with little or no efficiency.

SUMMARY OF THE INVENTION

The present invention provides a miter device which is slidable in the conventional linear grooves formed in a wood-cutting saw table. These grooves run, one on each side of the blade, in a direction parallel to the blade. A jig, having two fixed jig faces forming a right angle, is rotatably mounted on a guide rail which can slide in each of the linear grooves. When the jig is set to make a 45° cut, its apex is directed parallel to the cutting blade. The first of the two pieces of wood to be cut to form the mitered 90° corner is supported by one jig face and is pushed through the blade with the guide rail running in the first groove. The device is then transferred to run in the second groove. The second piece is placed to be supported by the other jig face and is pushed through the blade. If there is any inaccuracy in locating the apex in a plane precisely parallel to that of the cutting blade, the use of the single jig having the two fixed faces ensures that, though the first piece may be cut at something other than 45°, the second piece is cut at an angle which compensates for the error, so that the two pieces combine to form a 90° angle.

Broadly stated the invention is a miter device slidable in the linear grooves formed on a wood-cutting saw table on each side of the cutting blade, which comprises: a jig having a pair of work-supporting jig faces disposed to form a 90° apex; a guide rail for sliding along either of the grooves; said jig being rotatably mounted on the guide rail so that the apex may be directed parallel to the cutting blade.

DESCRIPTION OF THE PREFERRED EMBODIMENT

Figure 1A:
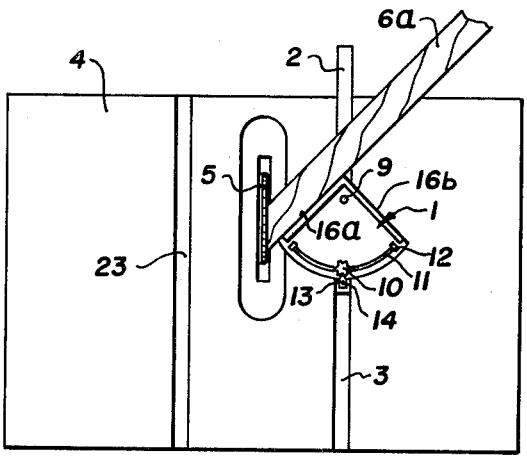
FIGS. 1*a* and 1*b* illustrate the jig of the present invention mounted on a guide rail slidable in either of the two linear grooves conventionally formed in a cutting table and additionally illustrate the method of cutting complementary pieces for a mitered corner.
Figure 1B:
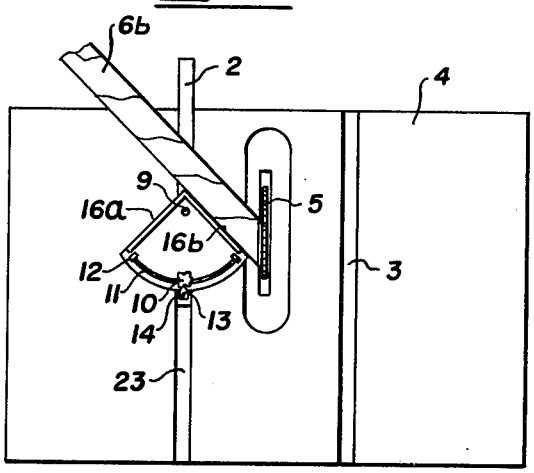
Figure 2:
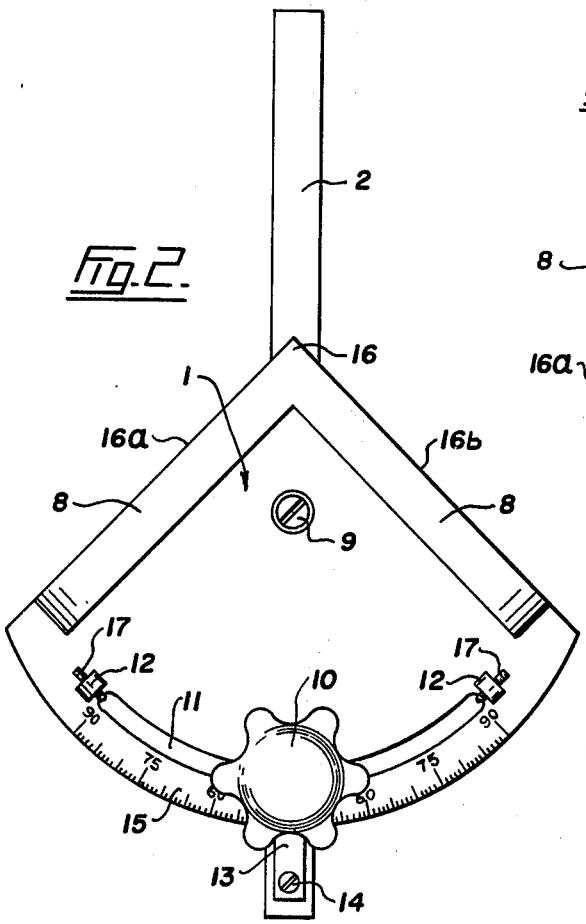
FIG. 2 is a top view of the miter device, showing a right-angled jig mounted onto a guide rail.

The miter device of this embodiment comprises a right-angled jig 1 mounted on a guide rail 2. The guide rail is adaptable to slide in the linear grooves 3, 23, normally formed in a wood-cutting saw table 4, which run parallel to the cutting edge 5 as shown in FIGS. 1*a* and 1*b*.

The jig 1 has two upstanding walls 8 which meet perpendicular to each other at an apex 16 and which provide jig faces 16*a*, 16*b*. The jig 1 is fastened to the guide rail 2 by fastening means such as a screw 9 positioned along the bisector of the right angle formed by the apex 16, such that the apex is directed parallel to the cutting blade when the jig is set for a 45° cut. The fastening means 9 secure the jig 1 to the guide rail 2 and may be slightly released to permit the jig to rotate thereabout. Attached to the guide rail 2 is an upright clamping means 10, such as a thumb screw, which protrudes through a curved slot 11 formed on the face of the jig and extending through $\pi/2$ radians. Abutments 12, forming part of the jig 1, are provided at each end of the curved slot 11.

Figure 3:
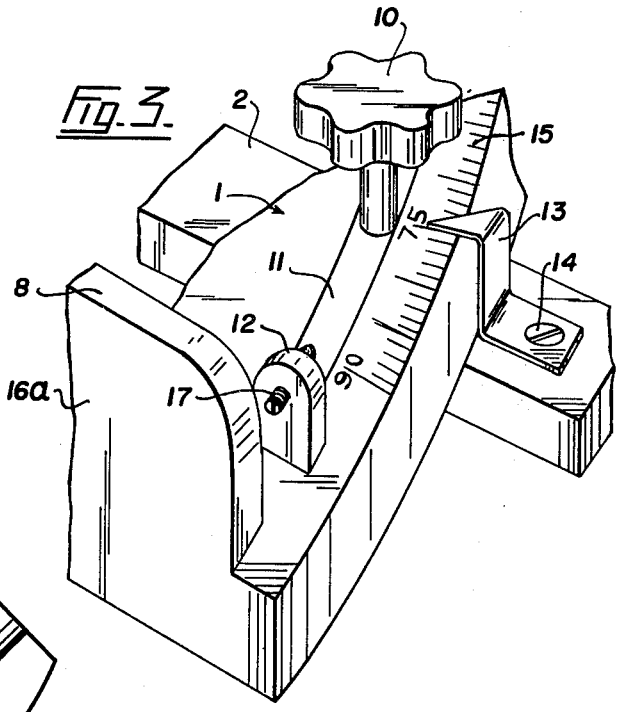
FIG. 3 is a perspective fragmentary view of the miter device.

A pointer 13, shown in FIG. 3, is adjustably fastened to the guide rail 2 by screw means 14. The pointer 13 functions to indicate the setting of the cut along a scale 15.

To set the jig in proper alignment with the cutting blade, the jig is rotated about its fastening means 9 to bring one of the jig faces 16*a*, 16*b* parallel to the guide rail 2 by loosening the clamping means 10. The pointer 13 then lies in the vicinity of the 90° graduation. Using a framing square 7 the other jig face is aligned perpendicular to the cutting edge 5, as shown in FIG. 7. The indicator 15 is then set to read exactly 90° by one or both of two adjustments. A stop 17, such as a screw, is inserted through the adjacent abutment 12 to limit the sweep of the upright clamping means 10 protruding through the curved slot 11 to its present position and/or means 14 fastening the indicator onto the guide rail can be adjusted to position the pointer to the 90° mark.

Figure 6:
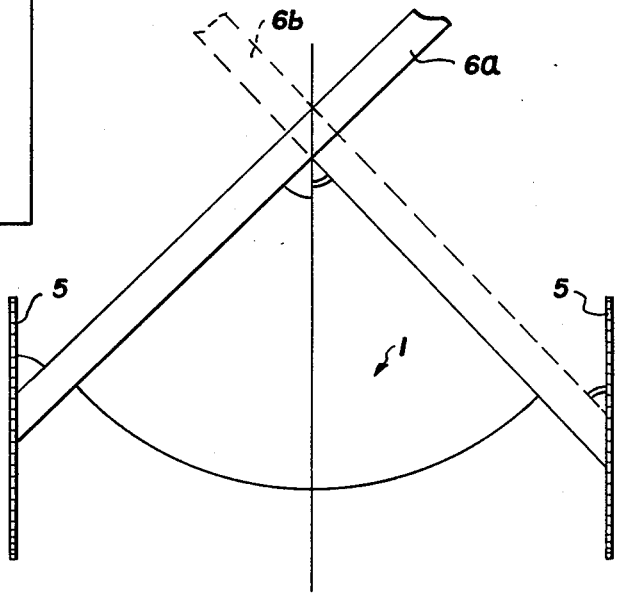
FIG. 6 illustrates the principle by which complementary cuts are obtained by using the miter.

Right-angled frames are easily cut using this device, by the method illustrated in FIG. 1. The jig is adjusted to 45° by pointing its apex 16 parallel to the cutting blade 5. It is clamped in that position relative to the guide rail 2 with means 10. A slab 6*a* is then supported against the jig face 16*a* facing towards the cutting blade 5 and the device is pushed along the groove 3 to guide the slab through the blade. Without changing the adjustment, the device is then transferred to a second parallel groove 23 running on the other side of the cutting blade 5 and the operation is repeated by supporting slab 6*b* on jig face 16*b*. The cuts thus obtained join to form a 90° corner. Even if the adjustment was not accurately set to 45° the right-angled shape of the jig insures that the cuts will be complementary, as shown in FIG. 6.

Figure 4A:
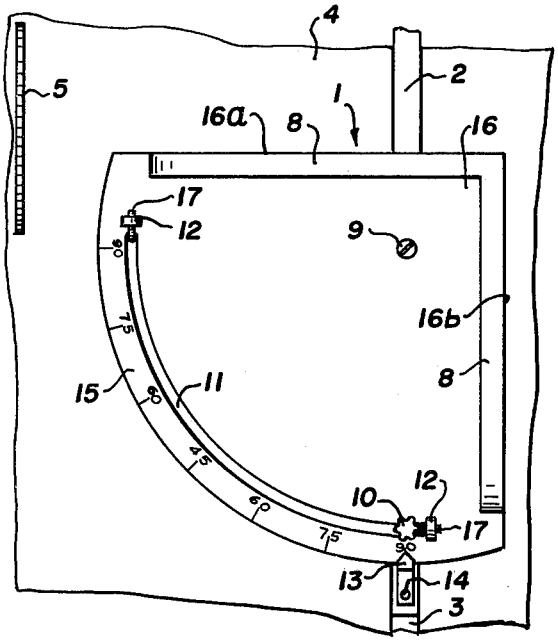
FIGS. 4*a* and 4*b* show the relative position of the miter device with respect to the cutting edge when adjusted in either of the 90° settings.
Figure 4B:
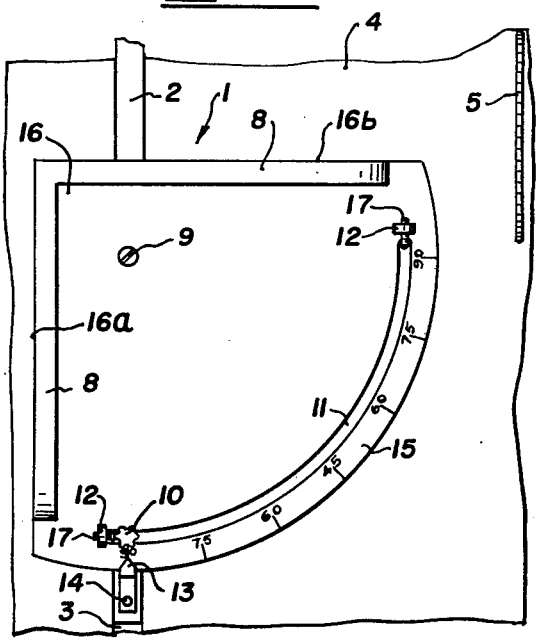
Figure 5:
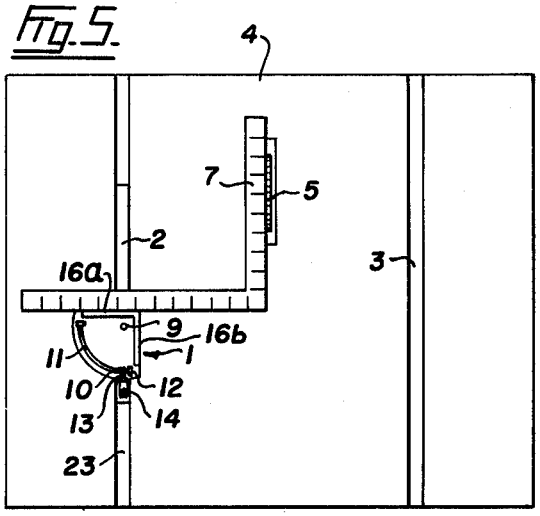
FIG. 5 illustrates the method of calibrating the miter device.

The fastening means 9 are preferably positioned in an offset manner, i.e. not midway along the bisector of the apex 16, but rather closer to the apex. If a perpendicular cut is to be made in a short piece of wood, the jig may be adjusted to the 90° setting farther from the cutting edge, as shown in FIG. 4*a*, which brings a long length of the supporting jig face 16*a* upstanding wall perpendicular to the cutting blade and between the guide rail and the saw. However, when a long piece of wood is to be cut, the alternate 90° setting is preferred since the second jig face 16*b* will support the slab with its long length on the side of the guide rail removed from the saw, as in FIG. 4*b*, allowing for a better gripping of the slab against the jig.

Although the miter device is especially useful in cutting 90° corners, it can be used to cut any angles. In addition, the upstanding walls 8 which extend above the face of the jig shield the fingers on the hand which feeds the jig past the cutting blade.

While the present invention has been disclosed in connection with a preferred embodiment thereof, it should be understood there may be other embodiments which fall within the spirit and scope of the invention, as defined by the following claims.

The embodiments of the invention in which an exclusive property or privilege is claimed are defined as follows:

1. A miter device slidable in the linear grooves formed on a wood-cutting saw table on each side of the cutting blade, which comprises:

a jig having a pair of work-supporting jig faces disposed to form a 90° apex;

a guide rail for sliding along either of the grooves;

said jig being rotatably mounted on the guide rail at a point along the bisector of the right angle;

said jig having a curved portion opposite the right angle, and a graduated scale along the circumference of the curved portion for setting the angle of the cut; and an upright clamping means operative to clamp the jig to the guide rail at the desired setting along the graduated scale.

2. A miter device slidable in the linear grooves formed on a wood-cutting saw table on each side of the cutting blade, which comprises:

a jig having a pair of work-supporting jig faces disposed to form a 90° apex;

a guide rail for sliding along either of the grooves;

said jig being rotatably mounted on the guide rail at a point along the bisector of the right angle;

said jig having a curved slot opposite the right angle, a graduated scale along the outer circumference of the circular slot, and abutments at each end of the curved slot;

said guide rail having an upright clamping means protruding through the curved slot of the jig operative to clamp the jig to the guide rail at the desired setting along the graduated scale; and said abutments being oriented radially on the face of the jig and through which stops can be inserted to limit the path of the upright clamping means on the guide rail along the curved slot on the face of the jig.

3. A miter device as set forth in claim 2 which includes a means on the guide rail for indicating the setting of the device along the graduated scale on the face of the jig.

4. A miter device as set forth in claim 2 wherein said jig is fastened to the guide rail at a point along the bisector of the 90° apex between the midpoint of the bisector and the apex.

* * * * *